United States Patent [19]

Yangas

[11] Patent Number: 4,683,362

[45] **Date of Patent: * Jul. 28, 1987**

[54] REFLECTIVE APPARATUS FOR MICROWAVE COOKING

[76] Inventor: Roger A. Yangas, 14000 Citation Dr., Orland Park, Ill. 60642

[ * ] Notice: The portion of the term of this patent subsequent to Sep. 3, 2002 has been disclaimed.

[21] Appl. No.: 765,374

[22] Filed: Aug. 14, 1985

Related U.S. Application Data

[63] Continuation-in-part of Ser. No. 652,897, Sep. 21, 1984, Pat. No. 4,539,454.

[51] Int. Cl.[4] ..... H05B 6/64

[52] U.S. Cl. ..... 219/10.55 F; 219/10.55 F; 99/DIG. 14; 426/243

[58] Field of Search ..... 219/10.55 F, 10.55 R, 219/10.55 A, 10.55 M, 10.55 E, 10.55 D; 99/DIG. 14; 426/243, 234

[56] References Cited

U.S. PATENT DOCUMENTS

| | | | |
|---|---|---|---|
| 3,316,380 | 4/1967 | Pansing | 219/10.55 F |
| 3,364,331 | 1/1968 | Johnson | 219/10.55 F |
| 3,461,260 | 8/1969 | Bremer | 219/10.55 F |
| 3,875,361 | 4/1975 | Fukui et al. | 219/10.55 B |
| 4,144,435 | 3/1979 | Clark et al. | 219/10.55 E |
| 4,539,454 | 9/1985 | Yangas | 219/10.55 E |

FOREIGN PATENT DOCUMENTS

| | | |
|---|---|---|
| 1615463 | 11/1974 | Denmark . |
| 1597226 | 6/1970 | France . |

*Primary Examiner*—Philip H. Leung

*Attorney, Agent, or Firm*—Silverman, Cass, Singer & Winburn, Ltd.

[57] ABSTRACT

A plurality of cells installed in a microwave oven reflect the microwaves and improve temperature uniformity of food heated in the oven. The cell includes a reflector which moves with variation in the response of a temperature sensor and varies the concentration of reflected microwaves incident on the food.

8 Claims, 10 Drawing Figures

FIG. 1
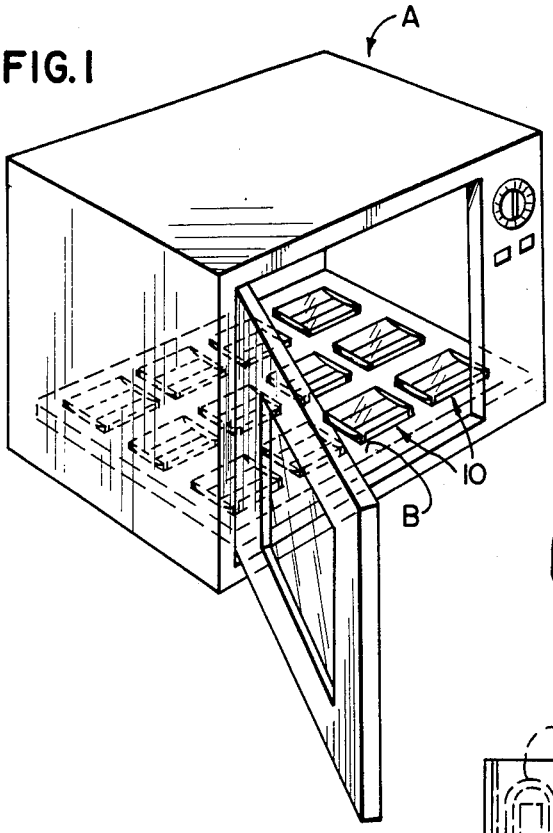
FIG. 2
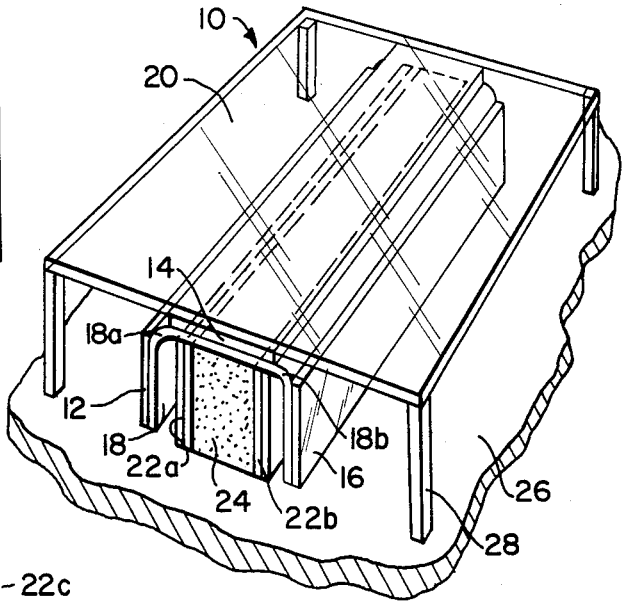
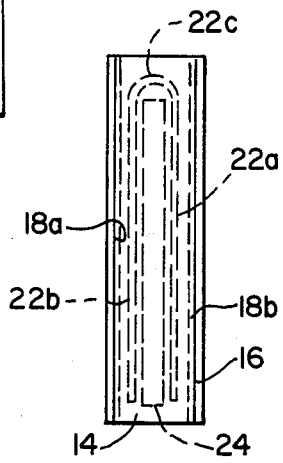
FIG. 3
FIG. 4A
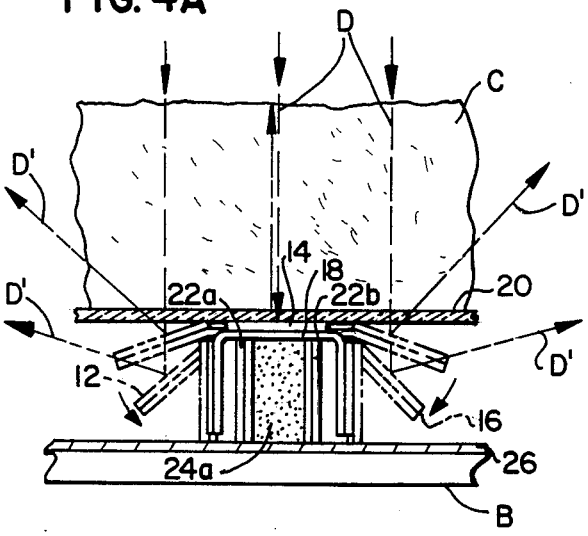
FIG. 4B
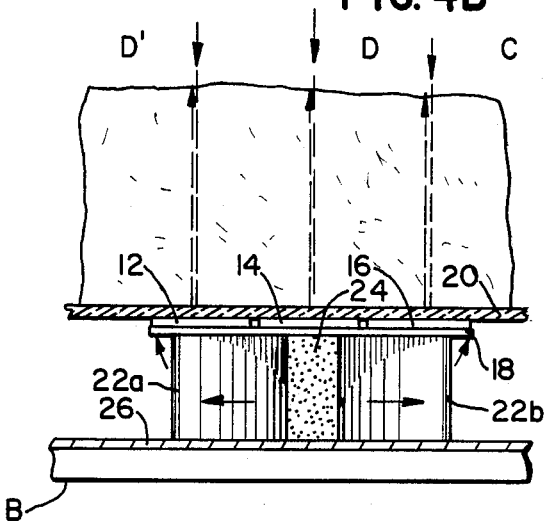

FIG. 5A
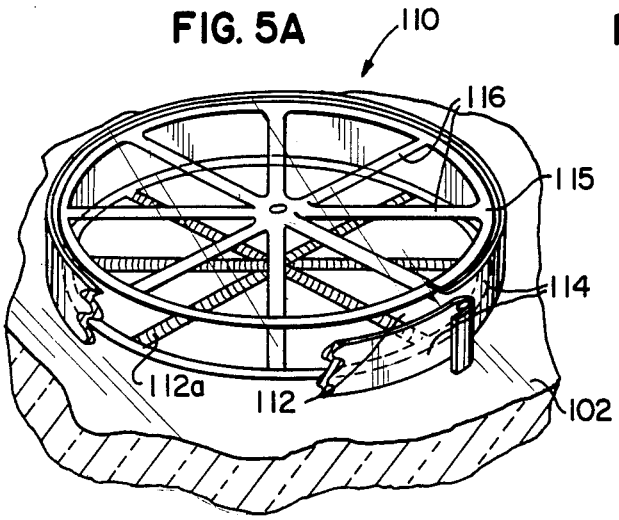
FIG. 5B
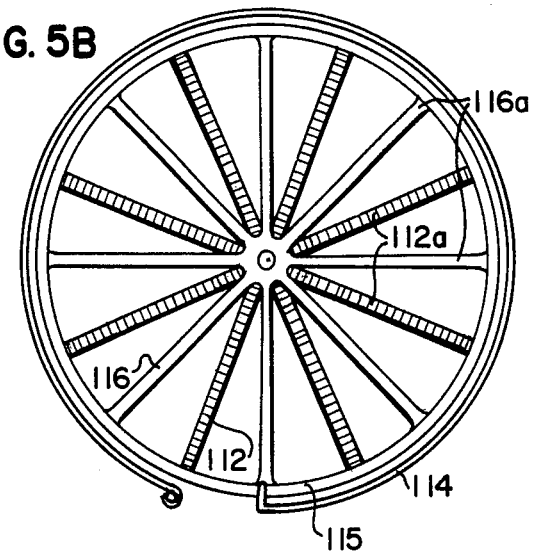
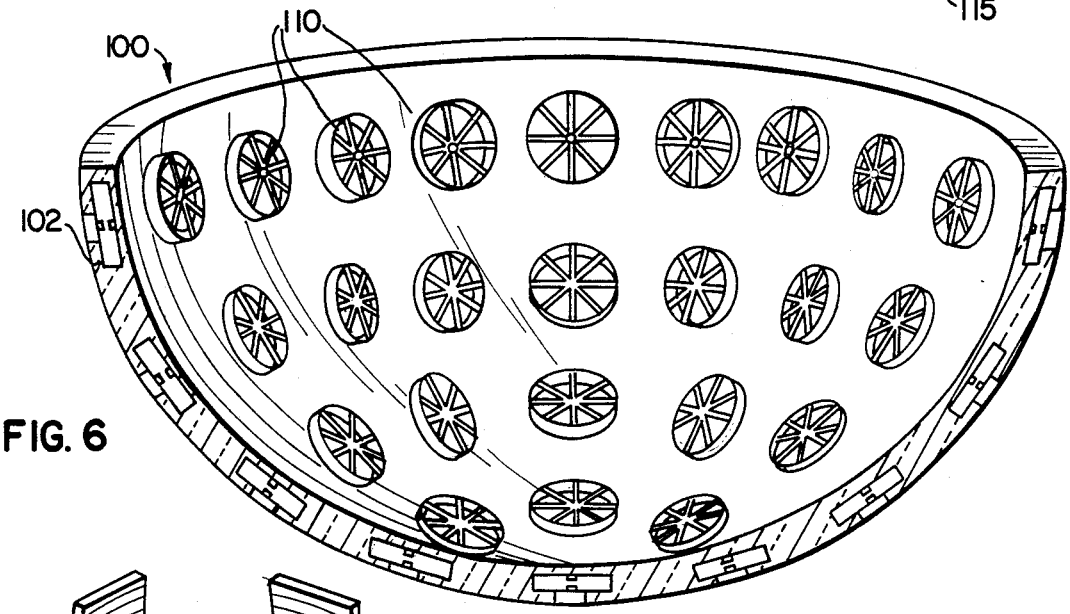
FIG. 6
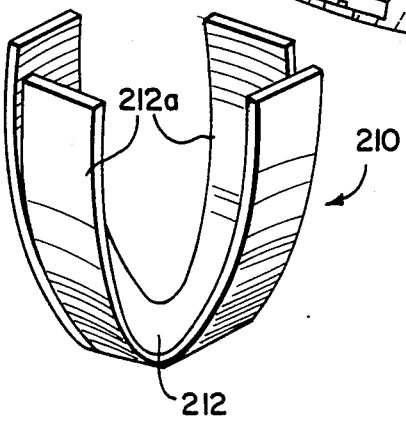
FIG. 7A
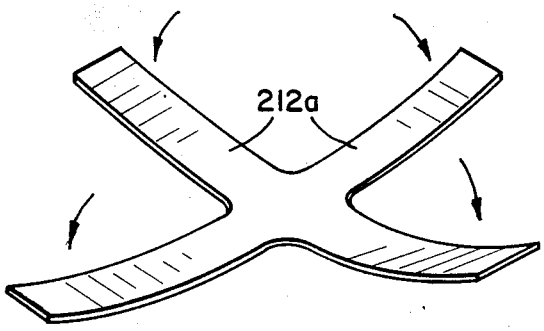
FIG. 7B

REFLECTIVE APPARATUS FOR MICROWAVE COOKING

CROSS-REFERENCE TO RELATED APPLICATION

This app;ication is a Continuation-In-Part of my application Ser. No. 652,897 filed Sept. 21, 1984, now U.S. Pat. No. 4,539,454.

BACKGROUND OF THE INVENTION

This invention relates to improvements in microwave cooking ovens and, more particularly, to apparatus for improving temperature uniformity in food cooked in such ovens.

The use of microwave cooking ovens has become widespread in both homes and restaurants and other food preparation institutions, primarily because food can be heated quickly and conveniently. When relatively large portions of food, for example, roasts and similar large meat portions are prepared in microwave ovens, the resulting cooking often leaves the food with unpleasant temperature differences located within the same portion. Such temperature differences are caused by localized concentrations of microwave energy within the food resulting in "hot-spots" in which the temperature is noticeably elevated relative to remote locations within the same integral portion. The reflective cells of this invention promote uniform heating of the food without such "hot-spots".

SUMMARY OF THE INVENTION

According to this invention, a plurality of reflective cells provide improved uniformity in the temperature of food heated in a microwave oven. Each cell includes a temperature sensor responsive to temperature generated in the oven and movable reflectors for reflecting the microwaves. The reflectors are movable with variation in the response of the temperature sensor, so that the reflectors vary the direction of the reflected microwaves relative to the food product and vary the concentration of the reflected microwaves incident on the food. Variation in microwave concentration at various strata within the food prevents excessive concentrations of microwaves therein and eliminates creation of "hot spots".

In one embodiment, a plurality of cells are mounted above the bottom wall of the oven below the level of the food product. Each of these cells includes a U-shaped bimetallic element having opposing arms. The arms spread and retract with respective heating and cooling of the bimetallic element. The movements of the arms drives pivotal motion of a pair of reflectors which are respectively engaged with the arms. The pivotal movement of the reflectors changes the direction of the reflected microwaves. The cycled pivoting of the reflectors creates changing microwave concentrations incident on the food product to promote heating to uniform temperature throughout.

In another embodiment, the cells are mounted in the wall of a food container. These cells have a bimetallic coil carrying reflectors which move with winding and unwinding of the coil.

BRIEF DESCRIPTION OF THE DRAWING

FIG. 1 is a perspective view of a microwave oven within which an embodiment of the reflective cells of this invention are installed;

FIG. 2 is an enlarged perspective view of one of the cells in FIG. 1, illustrating microwave reflecting elements movable by a bimetallic element;

FIG. 3 is a plan view of the cell of FIG. 2, illustrating the U-shape of the bimetallic element;

FIG. 4*a* is an end view, partially in section,of the cell of FIG. 2, illustrating the pivotal motion of the reflectors and changing direction of the microwaves reflected as a result of the motion;

FIG. 4*b* is a view similar to FIG. 4*a*, illustrating the reflectors fully pivoted into a horizontal coplanar configuration;

FIG. 5*a* is a perspective view of a modified embodiment of a cell according to the invention for incorporation into a food container, illustrating a bimetallic coil carrying microwave reflective element;

FIG. 5*b* is a plan view of a cell of FIG. 5*a*, illustrating the rotated position of the reflective elements with unwinding of the heated coil;

FIG. 6 is a perspective view, partially in section, of a bowl, illustrating a plurality of the cells of FIG. 5*a* incorporated into the wall of the bowl;

FIG. 7*a* is a modified embodiment of a reflective cell for incorporation into a food container, illustrating the cool condition of a bimetallic element having four arms in cone-like configuration; and FIG. 7*b* is a perspective view of the heated condition of the bimetallic element of FIG. 7*a* in which the arms are spread outwardly into a generally planar configuration to reflect the bulk of the microwaves directed at the element.

DESCRIPTION OF THE PREFERRED EMBODIMENTS

Referring to FIG. 1, a plurality of reflective cells in an embodiment of the invention, are generally designated by reference character 10 and installed within a conventional microwave oven generally designated by reference character A. The cells 10 can be arranged in rectilinear rows in which the cells are spaced at least 1/16 inch in order to prevent arcing between the cells 10. Preferably, the rows of cells 10 cover substantially the entire bottom wall B of the oven A and the cells are elevated at a distance, for example $\frac{3}{4}$ to 1 inch above the wall B. In this embodiment, the food to be cooked is placed above the cells 10 as more fully described hereinafter.

Referring to FIGS. 2 and 3*a*, each cell 10 includes three reflectors 12, 14 and 16 formed by strips of aluminum or similar material which reflects microwaves. The reflectors 12, 14 and 16 are bonded to a flexible rubber sheet 18. The reflectors 12, 14 and 16 are spaced approximately 1/16 to $\frac{1}{8}$ inch in side-by-side parallel arrangement. The middle reflector 14 is attached to a lower surface of a fixed plate 20 of plastic or similar material which is transparent to microwaves. This central reflector 14 is held horizontally stationary by the plate 20 which preferably extends to support the central reflector in all of the cells 10. The sheet 18 provides flexible hinging between the reflector 14 and each of the other reflectors 12 and 16, which allows the reflectors 12 and 16 to pivot in relation to the fixed central reflector 14. The reflectors 12 and 16 pivot about respective portions 18*a* and 18*b* of the sheet 18 narrowly separating the reflectors 12 and 16 from the fixed reflector 14. As shown in FIG. 2, when the oven A is not in operation, the reflectors 12 and 16 are pulled by gravity to extend in generally vertical parallel planes below the plane of the horizontally oriented reflector 14. In this configuration, the reflectors 12 and 16 face one another in spaced opposition. Between the vertically oriented reflectors 12 and 16, a U-shaped bimetallic element 22 is disposed so that the arms 22*a* and 22*b* of the U-shaped element 22 extend horizontally in generally spaced, parallel opposition between the reflectors 12 and 16, when the oven A is not in operation and the element 22 is in generally "cold" condition. Any conventional bimetallic element, for example copper-aluminum, can be employed in suitably fabricated, U-shaped configuration. The arms 22*a* and 22*b* can be dimensioned, for example, approximately ¾ inch in length and extend horizontally parallel and below the horizontal plane of the reflector 14. Between the arms 22*a* and 22*b*, a bar 24 of ferrite or similar material which readily absorbs microwaves is positioned to heat the element 22.

Referring to FIG. 3, the bight portion 22*c* of the element 22 is attached to the sheet 18 below the stationary reflector 14 so that the bight 22*c* is fixed while allowing the arms 22*a* and 22*b* to freely move horizontally between the positions illustrated in FIG. 2 and 4*b*. The bar 24 is stationary and can be attached to the bottom surface of sheet 18 below the central reflector 14. As shown in FIG. 2, the cells 10 have a floor 26 of plastic or similar material which is transparent to microwaves and both the bight 22*c* and the bar 24 can be alternatively fixed to the upper surface of the floor 26. Plastic columns 28 separate the plate 20 from the floor 26. The central reflector 14 shields the bar 24 from microwaves directly transmitted from the generator so that the bar 24 does not overheat.

Referring to FIG. 4*a*, a relatively large portion of food C is placed within the oven A above the plate 20 and will extend over a plurality of the cells 10, which are in the range 1–2 inches long. When the oven A is operated, the conventional microwave generator (not shown) directs microwaves represented by arrows D downward through the food C which absorbs some of the microwaves while other microwaves pass through the food C and are reflected upward by impingement against the central reflector 14 or the bottom wall B of the oven.

Additionally, the microwave generator directs some of the microwaves angularly against the sidewalls of the oven A which reflects these microwaves (not shown for simplicity) angularly downward through the food. Thus, microwaves are reflected from the bottom wall B in both normal and angular directions. As a result of numerous angularly reflected microwaves, the bar 24 will absorb microwaves and begin to generate heat. The heat generated by the bar 24 is conducted to the bimetallic element 22. As the element 22 heats, the arms 22*a* and 22*b* move apart or spread horizontally and force the respectively engaged reflectors 12 and 16 to pivot upwardly into the sequential phantom positions shown in FIG. 4*a*. As a result of the pivotal motion of the reflectors 12 and 16, some of the microwaves D which pass through the food C and the plate 20 will impinge on and reflect from the reflectors 12 and 16 at progressively different and decreasing angles as shown by the reflected microwaves D'. The reflected, microwaves D' pass through the food C at angles which change with the pivotal movement of the reflectors 12 and 16 and thus, traverse different paths through the food C as the pivotal motion progresses.

Referring to FIG. 4*b*, once the arms 22*a* and 22*b* have fully spread and forced the reflectors 12 and 16 into the horizontal coplanar position, the reflectors 12 and 16 will engage the lower surface of the plate 20 which is generally cooled by food which has only begun to heat. The reflectors 12 and 16 are thus cooled by the plate 20 resulting in cooling of the arms 22*a* and 22*b* which remain in respective engagement with the cooled reflectors 12 and 16. As the arms 22*a* and 22*b* cool, they retract inwardly toward one another allowing the respective reflectors 12 and 16 to pivot downwardly in the reverse paths of motion illustrated in FIG. 4*a*. Thus, after temporarily reaching the coplanar positions shown in FIG. 4*b* in which the reflected microwaves D' are directed upward and generally coincident with the impinging microwave D, the downwardly pivoting reflectors 12 and 16 will again reflect microwaves at progressively increasing angles in reverse of the progression shown in FIG. 4*a*. However, since the bar 24 continues to heat, the arms 22*a* and 22*b* become increasingly heated as they retract and will once again spread forcing the repeated upward pivot of the reflectors 12 and 16. As a result of the cycled, upward and downward pivotal motion of the reflectors 12 and 16, the microwaves reflected therefrom will also be directed at cycled, increasing and decreasing angles so that the food C is subjected to a changing gradient in concentration of microwaves D'. This changing gradient prevents absorption of microwaves at fixed concentrations in the various strata within the food, and thus eliminates creation of "hot spots". The effect of the cycled change in the direction of reflected microwaves D' in FIG. 4*a* will be multiplied by the microwaves initially directed by the generator against the sidewalls of the oven which are reflected therefrom to impinge the reflectors 12 and 16 and thus, are subjected to the similar change in reflected angles.

Each cell 10 operates independently of the other cells. The combined effect of the action of the cells is an upward shifting in the focus of microwave concentration (referred to as the power curve) in the design of the oven, as well as a multiplicity of motions redirecting reflected microwaves, both of which are particularly beneficial in microwave cooking of large or thick portions of food.

In modified embodiments, the cells can be incorporated into containers for cooking food, for example, a bowl. Referring to FIG. 6, a bowl generally designated by reference character 100 has a wall 102 within which are embedded a plurality of cells generally designated by a reference character 110 The wall 102 is plastic or similar material transparent to microwaves. Referring to FIG. 5*a*, the cell 110 includes a stationary generally circular configuration of diametrically intersecting rods 112 of aluminum or similar material which reflects microwaves. As best shown in FIG. 5*b*, the rods 112 form a pattern of eight radial projections, however the number of projections may be variable and is dependent upon maintaining a distance between the peripheral ends 112*a* less than approximately ½ inch, and therefore, fewer or greater than eight radial projections may be required depending upon the length of the rods 112 and the size of the cell 110. Each cell 110 further includes a generally circular, bimetallic coil 114 which circumscribes and is connected to a wheel 115 on which the ends of eight (8) diametrical spokes 116 are attached. The spokes 116 intersect coaxially with the intersection of the rods 112, and the coil 114 is dimensioned so that in its "cold" condition the spokes 116 are superimposed on rods 112 in congruent manner. The spokes 116 are also made of aluminum or similar material which reflects microwave.

Referring to FIG. 5*b* and 6, when the bowl 110 containing food product (not shown) is placed in a microwave oven and cooking is begun, the food heats and conducts heat to the coil 114. As best shown in FIG. 5*b*, the heated coil 114 expands in an unwinding motion so that spokes 116 are rotated from the superimposed position of FIG. 5*a* to the position of FIG. 5*b* in which the spokes 116 generally bisect the angles between the radial projections of the rods 112. In this position, the adjacent ends 112*a* and 116*a* of the respective rods 112 and spokes 116 will be at a distance of approximately $\frac{1}{4}$ inch. The microwave typically have a wavelength less than $\frac{1}{4}$ inch and the configuration of alternating rods 112 and spokes 116 effectively reflects the bulk of the microwaves directed at the cell 110. Particularly when the food is very cold or frozen, the peripheral area of the food can become heated and thus heat the coil of a particular cell 110, even though the interior of the food may temporarily remain cool or frozen. As a result, the peripheral area which heats the coil 114 can cool again by contact with flowing liquid produced in the heating process or by simple heat transfer to the remaining cool or frozen areas. Thus, the peripheral area of the food can again cool the coil 114 and reverse the rotation of the spokes 116 to approach their original position as shown in FIG. 5*a*, which again allows the microwaves to pass through the cell 110. The unwinding and winding of the coil 114 is thus dependent upon the heating and cooling of the peripheral area of the food in which a particular cell 110 is in contact. The combined effect of the coil motion in the plurality of cells 110 produces changing concentration of the microwave reflection passing through various strata within the food to promote uniform heating.

Referring to FIG. 7*a*, a reflective cell 210 is a modified embodiment of a cell for incorporation into the wall of a bowl or similar food heating container. The cell 210 includes a bimetallic element 212 which has four arms 212*a* which are bent from their central intersection to form a cone-like cruciform. The bimetallic element 212 can be stamped and bent into the cone-like configuration of FIG. 7*a*, and then incorporated into the wall of a container similar to the bowl in FIG. 6. Referring to FIG. 7*b*, when the microwave oven is operated and cooking is begun, the heated periphery of the food (not shown) heats the element 212 causing the arms 212*a* to spread outwardly into a generally planar configuration in which the arms 212*a* intercept and reflect the bulk of the microwaves directed at the cell 210. When the periphery of food products cools, the arms 212*a* will again fold inward to the cone-like configuration of FIG. 7*a*, followed by reheating into the configuration of FIG. 7*b*. In this embodiment, the element 212 serves as both the bimetallic element and the reflector.

The combined motions of the cells 210 promote uniform heating of the food by changing the concentration of microwave reflection passing through various strata within the food.

Variation in the size and structural features of cooperating parts and the materials used may occur to the skilled artisan without departing from the scope of the invention which is set forth in the claims hereto appended.

I claim:

1. A reflective cell in combination with an oven for improving uniformity in the temperature of a food product heated in a radiant energy heating cavity of said oven, comprising:

A. an oven having a radiant energy heating cavity;

B. temperature sensor means responsive to heat generated within said cavity, said temperature sensor means including a bimetallic element, said bimetallic element having a U-shaped configuration including a pair of spaced, opposing arms, said arms being generally parallel in unheated condition of said bimetallic element, said arms being spreadable when said bimetallic element is heated and retractable when said bimetallic element is cooled;

C. movable reflection means for reflecting radiant energy within said cavity, said movable reflection means also being located in said cavity, said reflection means including a pair of reflective members engaging said respective arms and movable therewith; and D. said reflection means being movable with variation in the response of said sensor means to said heat, in order to vary the direction of said reflecting radiant energy relative to said food product and to vary concentration of said reflecting radiant energy incident on said product for promoting said temperature uniformity therein.

2. The cell of claim 1 further comprising a bar positioned between said arms, said bar having a composition which readily absorbs said radiant energy for heating said bimetallic element.

3. The cell of claim 2 further comprising a third reflective member located to provide shielding of said bar against a portion of said radiant energy.

4. The cell of claim 1 wherein said reflective members are supported on a flexible support member enabling pivotal movement of said reflective members about fixed portions of said flexible member.

5. The cell of claim 4 wherein the movement of said arms enables pivotal motion of said respective reflective members through an angle of approximately 90°.

6. A reflective cell in combination with an oven for improving uniformity in the temperature of a food product heated in a radiant energy heating cavity of said oven, comprising:

A. an oven having a radiant energy heating cavity;

B. temperature sensor means responsive to heat generated within said cavity, said temperature sensor means being located in said cavity, said sensor means including a bimetallic coil carrying a plurality of reflective members, said reflective members being movable with winding and unwinding of said coil and including a plurality of stationary reflective members with respect to said movable reflective members and said stationary reflective members including a first circular array of radial projections, and said movable reflective members including a second array of radial projections coaxial with said first array;

C. movable reflection means for reflecting radiant energy within said cavity, said movable reflection means also being located in said cavity; and D. said reflection means being movable with variation in the response of said sensor means to said heat, in order to vary the direction of said radiant energy relative to said food product and to vary the conectration of said radiant energy incident on said product for promoting said temperature uniformity therein, sensor means combined with a container for heating food in said oven, wherein said cell is supported on a wall of said container.

7. A reflective cell in combination with an oven for improving uniformity in the temperature of a food product heated in a radiant energy heating cavity of said oven, comprising:

A. an oven having a radiant energy heating cavity;

B. temperature sensor means responsive to heat generated within said cavity, said temperature sensor means being located in said cavity and separate from said food product;

C. movable reflection means for reflecting radiant energy within said cavity, said movable reflection means also being located in said cavity;

D. said reflection means being movable with variation in the response of said sensor means to said heat, in order to vary the direction of said radiant energy relative to said food product and to vary the concentration of said radiant energy incident on said product for promoting said temperature uniformity therein; and E. said sensor means includes said reflection means, said sensor means and said reflection means including a bimetallic element having a plurality of integrally connected, reflective arms and said arms define a cone-like configuration in the unheated condition of said bimetallic element, said arms being spreadable to form a generally coplanar configuration of said arms when said bimetallic element is heated.

8. The cell of claim 7 in combination with a container for heating food in said oven, wherein said cell is supported on a wall of said container.

* * * * *